United States Patent [19]

Holmes

[11] 4,193,518

[45] Mar. 18, 1980

[54] PORTABLE WATER CARRIER AND DISPENSER

[76] Inventor: William A. Holmes, 209 Highland Ave., Piedmont, Calif. 94611

[21] Appl. No.: 793,678

[22] Filed: May 4, 1977

[51] Int. Cl.[2] ..... B65D 37/00; A45F 3/20

[52] U.S. Cl. ..... 222/105; 222/175; 222/180; 222/464; 222/527; 150/1; 224/148

[58] Field of Search ..... 222/92, 105, 464, 564, 222/175, 527, 529, 530, 180; 150/1, 0.5; 224/148

[56] References Cited

U.S. PATENT DOCUMENTS

| | | | |
|---|---|---|---|
| 350,544 | 10/1886 | McKenney et al. | 222/464 X |
| 1,395,753 | 11/1921 | Wehle | 222/464 X |
| 1,619,120 | 3/1927 | Heaton | 222/175 X |
| 1,902,548 | 3/1933 | Fenwick | 222/175 X |
| 2,435,743 | 2/1948 | Geimer | 150/1 X |
| 2,793,073 | 5/1957 | Bateman | 222/175 |
| 3,100,587 | 8/1963 | Cox | 222/105 |

FOREIGN PATENT DOCUMENTS

| | | | |
|---|---|---|---|
| 927692 | 6/1963 | United Kingdom | 150/0.5 |

*Primary Examiner*—Robert J. Spar
*Assistant Examiner*—Frederick R. Handren
*Attorney, Agent, or Firm*—Townsend and Townsend

[57] ABSTRACT

A portable water carrier and dispenser comprising a pillow-shaped enclosure of strong, lightweight, flexible material; a reservoir, similarly shaped, of impermeable material, adapted to receive and retain water disposed within the enclosure; a conduit for establishing fluid communication with the reservoir interior; and shoulder straps and waistbelt attached to the enclosure to allow a user to carry the dispenser on his back. The volumetric dimensions of the reservoir are slightly greater than those of the enclosure to allow the enclosure to provide bottom and side support for the reservoir when containing water. One end of the conduit is interior the reservoir, and secured to the bottom corner thereof. The other bottom corner of the reservoir is held in place within the enclosure when the reservoir is empty by a special clamp provided for this purpose. A plurality of apertures are provided proximate the interior end of the conduit and near the reservoir bottom to allow water to flow freely into and out of the reservoir. This flow is controlled by a double shutoff Wye valve at the exterior end of the conduit. A protected elastic seal binds the opening of the reservoir to the tubing at the top of the enclosure. A locking drawcord system is used to shape the enclosure as desired for transport.

11 Claims, 8 Drawing Figures

PORTABLE WATER CARRIER AND DISPENSER

This invention relates to water carrying and dispensing apparatus and is more particularly concerned with portable water-carrying and dispensing apparatus suitable for use by campers, backpackers and the like.

DESCRIPTION OF THE PRIOR ART

Among the many recreational activities engaged in today by the public, overnight hiking, backpacking, bicycling and camping are among the more popular. It has become desirable for many to "get away from it all" and establish a rapport with nature. Hikers, bicyclists, backpackers and the like often journey into semideveloped or undeveloped areas for overnight or even longer stays. In many instances such journeys are made under the requirement that the individual carry everything he wishes to take with him. Thus, weight of the articles taken on the journey becomes a prime concern; and the longer the period of time to be spent away from civilization, the more attention given to the articles carried and their weight.

During such overnight (or longer) journeys into semi-or undeveloped areas, camp is pitched in surroundings as desirable as possible, preferably close to a ready supply of water. Unfortunately, it is not always possible to pitch camp at day's end as near a supply of water as desired.

In such cases the traveler must set up his camp, locate a water source, and then transport sufficient quantities of water to his campsite for drinking, cooking, bathing, washing dishes and laundry, etc. This usually amounts to anywhere from five to thirty gallons per person per day, on the average. Thus, the need arises for apparatus that can be carried with the camper and can be used for transporting, holding, and dispensing water in comparable quantities. Like all other articles the camper carries on his back, this unit must also be lightweight, compact, and dependable; that is, it should not require replacement on the trail.

Though it may seem surprising at first, the public actually has a much greater need for a good water dispenser in areas where it is possible to camp directly adjacent to natural water sources. This bears some explanation:

Today, more than ever before, there seems to be developing an appreciation for the natural beauty with which our country was once so richly endowed. Perhaps this is because the public has come to realize that this natural beauty is rapidly disappearing. Many an old favorite spot in the countryside, once taken for granted, has been returned to in recent years only to find that it has been spoiled, perhaps permanently, by pollution. This, of course, is a grave loss, and irreplaceable.

This general decline in the availability of really choice natural areas, coupled with a large increase in the number of people seeking such areas, is sending increasing numbers of people further and further into the less accessible—and, as yet, truly uncontaminated—areas once visited by only a few backpackers. This trend is currently increasing and no doubt will continue to increase. Consequently, such areas—once thought to be protected by their remoteness—are now being threatened with pollution.

Simply making the present invention—an advanced water carrier and dispenser—available to backpackers and campers may well do more than all other measures combined to protect these remaining primitive areas from the inevitable contamination which they now face. The reasons for this statement should become clear from the discussion which follows:

It should be pointed out that when one speaks of pollution of a natural environment, he is speaking, to a large extent, of pollution of its waterways. Springs, rivers, streams and lakes are truly the bloodstream of the natural environment. They are essential to all of its life forms. To keep them clean is to keep the environment, and all its life forms, clean and healthy.

The single most important thing that the camper can do to prevent pollution of natural water sources is to establish a camp water supply which is removed from them. Otherwise, bathing, usually with soap, is often done directly in a lake or stream, as are laundry and dishwashing, resulting (perhaps unknowingly) in considerable chemical pollution. Also, the likelihood of excretory contamination of the water source is reduced if a separate camp water supply is available. These are the main sources of water pollution from campers, and they are to blame for a major portion of the pollution which has already taken its toll on our primitive areas.

Unfortunately, to date it has been very difficult for the camper to avoid causing pollution from these sources, because there simply has not been a water dispenser (much less a water carrier) available until now that can meet even the minimum requirements of backpackers and campers.

Foremost among these requirements (in addition to the light weight, compactness and dependability referred to earlier, which all of a backpacker's gear must have) is the requirement of sufficient capacity. If a separate camp water supply does not have sufficient capacity, this will render it not only generally less useful, but also practically ineffective in reducing pollution. This is the biggest problem with the dispensers now available. Very limited in capacity, they are often used only for cooking and drinking water storage. Bathing, laundry, and dishwashing—the major sources of chemical pollution—usually require considerably more water than these dispensers can hold (even when only small groups of people are involved) and thus are likely to be done directly in a lake, stream, or spring, resulting in pollution.

Even if the dispensers now available did have sufficient capacity, the difficulty of filling and transporting them, plus their numerous other shortcomings make them very inconvenient to use. Most campers probably would still not take the extra effort required to use them for bathing, laundry, dishwashing, and other chores requiring large quantities of water, if natural water sources were also close at hand.

Until now, there have been basically two types of portable water dispensers available—those made entirely of a waterproof vinyl or plastic-type material, and those made entirely of a waterproofed canvas-like material. Both of these two materials, used by themselves, have crippling disadvantages for this application.

The vinyl or plastic containers lack strength, and consequently, their capacity is very limited. Five gallons is about the largest available. They mostly lack flexibility, tending to crack, and are adversely affected by heat and sunlight. Any damage to them—a common occurrence even in normal use—usually cannot be repaired and the entire unit must be replaced. This is difficult or impossible on the trail, and often leads back to direct use of natural water sources, and, consequently, pollution.

The waterproofed canvas-type dispensers are heavy. Once they become wet and waterlogged (an inevitability), they are extremely heavy and stay wet for a long time, both points being highly undesirable to the backpacker, of course. Because this type of dispenser is not a sealed unit, it is somewhat vulnerable to contamination from windblown dust, leaves, insects, etc. They usually leak, because it is difficult to adequately waterproof the seams. Moreover, such canvas-type dispensers require periodic rewaterproofing to minimize leakage, a task that is difficult on the trail. Damage of this type of dispenser, while somewhat less frequent than damage to those dispensers constructed entirely of plastic or vinyl, is usually difficult to repair satisfactorily on the trail, and may likewise result in pollution through direct use of natural water sources. This type of dispenser can have larger capacity than the vinyl or plastic type, but increases in size cause increased pressure, and increased leakage through the seams.

Clearly then, both of the two conventional types of water dispensers leave a great deal to be desired. Neither dispenser type can meet the backpacker's basic requirements of sufficient capacity, light weight, compactness, dependability, and freedom from leakage.

In addition, both are difficult, and slow, to fill. The canvas type must be hung while being filled, while the plastic type must be immersed. Also, neither of the two is really made for transporting water—only for dispensing it. It is both awkward and tiring to carry either for any distance.

SUMMARY OF THE INVENTION

The present invention, on the other hand, meets all the requirements of the backpacker, and combines a number of additional advantages, as will be shown later.

Definitely a breakthrough, this is the first portable liquid storage unit to take full advantage of a unique property of liquids—that of seeking hydrostatic equilibrium. By its special double-membrane feature, which separates the water impermeable and strength requirements, this invention allows for the first time large capacity with light weight. The essence of the double membrane is that a strong, flexible outer membrane or enclosure takes the full perimeter stress of the contained liquid while an impervious flexible inner membrane or reservoir of equal or preferably slightly greater volume, is simply compressed against the outer membrane by the contained fluid. The two together, being flexible, deform to minimize the stress on the outer, supportive membrane. Though separate, they act as one membrane, combining the useful properties of both, when the apparatus is in service.

Clearly, the double membrane was the needed concept. Before its appearance, developments in portable water dispensers had remained, and would continue to remain, at the same stubborn impasse—that of trying to use one type of waterproof material. Since no single waterproof material in existence combines the needed qualities of strength, light weight, impermeability, and flexibility, a new idea was needed.

Although the double membrane is the concept that makes this advanced water carrier and dispenser possible, several other features of its construction also set it apart from the other dispensers available. Basically, the present invention includes a pillow-shaped enclosure of strong, lightweight, and flexible material, which removably contains a lightweight impermeable reservoir adapted to readily receive and retain water. The enclosure has a short reinforced section of considerably reduced diameter just below the opening at the top and is provided with adjustable shoulder straps and waistbelt to allow the apparatus to be carried like a backpack.

The enclosure opens at the top and is provided with drawstrings for closure. The reservoir is shaped like the enclosure with a top opening positioned near the enclosure opening when the reservoir is situated in the enclosure. Since the volumetric dimensions of the reservoir are slightly greater than the corresponding volumetric dimensions of the enclosure, the bottom and side portions of the enclosure provide ample support for the bottom and side portions of the reservoir against the hydraulic pressures of the water contained therein. This is the double membrane effect referred to earlier.

A length of tubing is provided, one end of which is positioned in the reservoir to establish fluid communication therewith. The end of the tubing interior the reservoir extends to the bottom of the reservoir where it is secured by a connection at a point which also joins the bottoms of the enclosure and reservoir together at one corner. The reservoir is held in place in the other corner of the enclosure when the two are empty by a clamp made specifically for this purpose. A number of apertures are located proximate the interior end of the tubing to allow free flow of water into and out of the reservoir via the tubing.

The enclosure and reservoir are closed about the tubing at the top of the dispenser—the reservoir by an elastic seal, and the enclosure by a pair of drawstrings located above and below this seal and serving to protect it.

The exterior end of the tubing has a double shut-off Wye valve attached to it to control water flowing into and out of the reservoir. Two other conduits also attach to this Wye valve, and communicate with the outside. Either of these conduits can be fitted with a shower head, when the camper desires to use the dispenser as a portable shower. A snap attached to the reinforced ring at the top facilitates raising and lowering the dispenser for this purpose. A locking drawcord system is provided to shape the enclosure as needed for transport. In an emergency situation the enclosure may be used as an auxiliary knapsack.

A number of advantages are achieved by the portable water carrier and dispenser of the present invention. A listing of these advantages follows. As can be seen, most of these advantages are made possible through the use of a double membrane.

(1) Increased Capacity

The first being the increased capacity of the present invention to handle greater amounts of water. The capacity of this dispenser is limited only by the carrier. It will hold and comfortably carry as much water as a man can lift, or considerably more if desired, due to the added strength of the double membrane construction.

(2) Light Weight and Compactness

This double membrane construction of the present invention lends itself well to the use of lightweight materials. The reservoir and enclosure are preferably constructed of lightweight plastic and nylon respectively. The tubing and Wye valve are of lightweight plastic. The entire unit weighs considerably less than anything previously available with half of its capacity. When not in use, it rolls into a small nylon bag and is stored, dry, among the camper's other belongings.

(3) Easier and Quicker Filling

This dispenser is very easy to fill. It need not be plunged into the water or hung while filling. It fills easily and completely by a siphoning action through the attached Wye valve, and need not be opened for filling. Details of this procedure are given in the section entitled "Detailed Description of the Preferred Embodiment", which follows this section. The dispenser can also be quickly and easily filled from a hose without spillage while still on the back of the carrier. Due to the use of the flexible double membrane, there is no need to vent the dispenser while filling or emptying it. This, of course, saves a great deal of time, especially when larger quantities of water need to be transported.

(4) Maximum Portability and Adaptability

The water carrier and dispenser of the present invention can carry a maximum load of water, comfortably, using only one man (and without getting him wet, because it does not leak at all). Even when containing water, the present invention is as ideally suitable for transport through rough country as any backpack. If it becomes necessary to reduce the load en route due to fatigue, hazardous conditions, etc., it is not even necessary to remove the carrier from one's back. All that is necessary is to open one side of the Wye valve while still hiking and close it again after the desired amount of water has been released.

Further, by simply loosening or tightening the drawcords attached to the enclosure, the carrier can quickly expand or reduce the capacity of this dispenser, raise or lower its center of gravity, or otherwise shape it for easier carrying. Once it has been adjusted to the desired shape, it will be held in this shape by the cordlocks attached to the drawcords on the outside, and by the hydrostatic pressure of the liquid on the inside.

If the user finds it necessary to carry water for very long distances, the present invention is easily adapted for use with a rucksack or packframe. To do so, all that is necessary is to loosen the drawcords, situate the unit inside the rucksack or knapsack, and fill it as usual. The unit will conform to and fill the available space in the pack.

The drawcord system attached to the enclosure also enables one to adapt the unit for different situations such as transport by bicycle, horseback, alpine use, boating, or the like. For constant use in one of these specialized modes, the enclosure could be sewn into a different shape, but for all-around use, the "pillow" shape described is readily adaptable to most situations by use of the drawcords. Water, by its nature, lends itself well to this. But again, without a double membrane, this would not be possible.

(5) Maximum Dependability

The present invention is extremely durable, and should not, with normal use, require repair or replacement on the trail. With double membrane construction, the light inner water-retaining reservoir is protected by a tough outer enclosure. This greatly reduces the chances of damage to the reservoir itself by puncture or abrasion. However, in those rare instances where both the enclosure and reservoir contained therein are pierced, it is a simple matter to place the unit back in service. All that is necessary is to replace the damaged reservoir with a spare that could be carried with the camper for just such an emergency and to repair the damage to the outer enclosure by hand sewing.

Moreover, the chances of damage to the water-retaining reservoir are further reduced by the fact that the suspension system is not attached to it and it is not penetrated by the drainage system, as is the case with the other dispensers now available.

(6) Coupling Capacity

Two or more units of the present invention can be easily coupled together for larger capacity. They can be placed at different heights if desired, to increase the water pressure or simply for convenience. One can be situated in the sun and one in the shade for hot and cold water, if desired. Additional Wyes and branches of various lengths can also be added, and a camp water system of any configuration (and any size) desired can be quickly and easily coupled together. This is very convenient for larger groups and will serve to further reduce pollution by centralizing the toilet and washing facilities. In a campground area it is better to have these facilities confined to specific locations rather than haphazardly spread around. No other dispenser now available or previously available has had the capacity to couple into a closed system like this.

(7) Showering Capacity

The water dispensing capabilities of the present invention provide an ideal shower, and make it unnecessary to stand in or alongside a small tub for bathing. This eliminates the need for carrying such a tub for bathing purposes, which normally would have considerable weight and be difficult to pack due to its size, shape, and rigidity. In addition, less water is needed for showering than for bathing in a tub, since showering makes more effective use of water, particularly in rinsing. This fact will be appreciated when it is necessary to haul water any distance for bathing. All that is necessary to adapt the unit for showering is to attach a nozzle to the exterior end of the tubing and regulate the flow by means of the Wye valve or a valve attached to the nozzle. Adjustable lightweight plastic nozzles are readily available that will adjust the flow from a full stream to a fine mist to no flow at all simply by a twist of the nozzle. These are ideal for this use, and fit the standard threads on the end of the conduits.

Many outdoor-oriented people who otherwise enjoy camping and backpacking find it very unpleasant to be without easy and efficient means of keeping clean. By providing such means, this dispenser will do a great deal to promote the comfort of living in the outdoors—perhaps more than anything to date.

Setting up tents, hauling firewood, cooking, etc. usually takes considerable time while camping. If a group completes hiking into a campsite in mid or late afternoon, as is often the case, they are doing well to have camp pitched and dinner ready to eat by nightfall, even without taking time out for bathing. Since bathing is essential to the comfort of most people in such a situation, anything that can speed the process is, of course, very welcome.

By using a black or dark-colored enclosure and simply suspending it in the sunlight, a supply of warm water will usually be available from mid-morning to well after dark. This makes it possible to bathe quickly and easily, even after dark when necessary, and with warm water if desired. If the carrier/dispenser of the present invention is covered with a blanket or sleeping bag, or just a heavy shirt, the water will of course retain its warmth considerably longer. In hot areas, if cool water is desired, it can be had even if there is no shade available. All that is necessary is to put an undershirt or some other light-colored covering over the dispenser, and it will stay pleasantly cool even in full sunlight.

Wetting this covering will lower the temperature still further.

A portable fresh water shower such as this will fill a great need in areas near the ocean. Many people enjoy surfing, scuba diving, and swimming in salt water but prefer to rinse the salt off their skin (or equipment) when they come out. Before now, this has been very difficult to do unless one is near a faucet or outdoor shower. But, with this dispenser it will be a relatively simple matter to have warm or cool water available for rinsing at any beach which can be reached by foot.

(8) Firefighting Capacity

Another advantage of the present invention—and one which should not be underrated—is that it gives the backpacker (or camper) the capacity to control small fires.

The backpacker, of course, must keep his load to a minimum. He cannot afford to carry a fire extinguisher or any other additional equipment for controlling fires. For this reason, he has had practically no fire protection in the past (beyond maybe a dishpan or collapsible bucket full of water). Thus, fires which might have easily been stopped at an early stage have sometimes gotten out of control and caused considerable damage in our forest areas. Now, however, while using this dispenser in its normal capacity around camp, the backpacker will have the capability to stop most fires originating in the camp area that might otherwise get out of control—without taking any special precautions or carrying any additional equipment.

Just as normally used in camp, this invention makes an effective portable fire extinguisher. Quick and easy to fill, it also has a maximum capacity and portability—both being highly desirable for a fire extinguisher. With an adjustable shower nozzle attached (as it would normally have in camp use), its effectiveness is increased. The only apparent disadvantage that this dispenser has when compared to a standard (steel) water fire extinguisher is that it cannot be effectively pressurized. Thus, as is, it will not spray higher than the top of the liquid in the reservoir. This could easily be overcome by the addition of a small hand pump, and for use primarily as a portable fire extinguisher, such a pump would be a very worthwhile addition to make. But, for a large majority of the fires that a backpacker may encounter, a hand pump will not be necessary. Most of these fires start at, or just above ground level (usually near the campfire or cooking area), and move upwards only when they reach a tree or high brush. Even then, the place to stop them is low, near the base of the flames. The main use for a small fire extinguisher is for fires at this stage anyway—to stop them before they get out of control. Most fires that may occur around camp can be stopped relatively easily at this stage. Once a fire has made a good start up a tree, however, it will usually require more than a fire extinguisher to stop it. However, if this dispenser were hung in an elevated position, and had a short length of hose attached, the camper could also reach low overhead fires in the vicinity, without a hand pump attached.

In normal use the present invention would be suspended from an elevated position (as for showering or dispensing) anyway—and within range of the cooking and campfire area.

Thus, with no additional effort on the part of the backpacker (or camper), he will now have, through the use of the present invention, the capacity to stop small fires in the cooking and campfire area before they get out of control. Since the vast majority of forest fires originating from campers and backpackers start in and around the cooking and campfire area, this should be a considerable help in protecting our remaining natural areas from fire damage.

(9) Other Advantages

The reservoir itself can be made of light, disposable materials. Thus it can be changed easily in the event of contamination, or to prevent the accumulation of sediment or algae, or if it begins to show signs of deterioration.

Also, because the tubing can be made of standard-sized hose, it can receive any standard threaded attachment that one may want to use—such as sprinkling attachments for plants, additional valves, special nozzles, etc.

It should be pointed out here that this unit is ideal for watering plants anyplace out of reach of a faucet and hose. For establishing a small hillside vineyard or just a few trees away from the house, one of these units will be a marked improvement over the conventional water cans. As was mentioned earlier, when filled from a garden hose, it is not even necessary to remove the unit from the carrier's back. All that is necessary is to couple the hose to one of the conduits (quick couplings could be used for this if desired), open the Wye valve (or an auxiliary valve on the end of the conduit if preferred) and turn on the water. The unit will fill as quickly as the faucet can run. (No venting is necessary during filling or emptying, due to the use of the flexible double membrane.) Then simply turn off the faucet, shut the valve, uncouple, and proceed. A full load of water is obtained in a minimum of time, and without spillage. Because it carries a maximum amount of water well, and drains quickly, watering time can be greatly reduced. Also, the carrier's hands are left free during transport. This is highly desirable when it is necessary to do any climbing or cross any rough terrain with a load of water. Excellent flow control onto even small plants can be obtained with this unit by the attachment of the proper nozzle, which will also serve to reduce watering time, as well as making more effective use of the water hauled. This, of course, is not possible with the water cans formerly used for jobs like this.

For a more complete understanding of the nature and advantages of the present invention, reference should be made to the ensuing detailed description taken in conjunction with the accompanying drawings.

DETAILED DESCRIPTION OF THE PREFERRED EMBODIMENT

Figure 1:
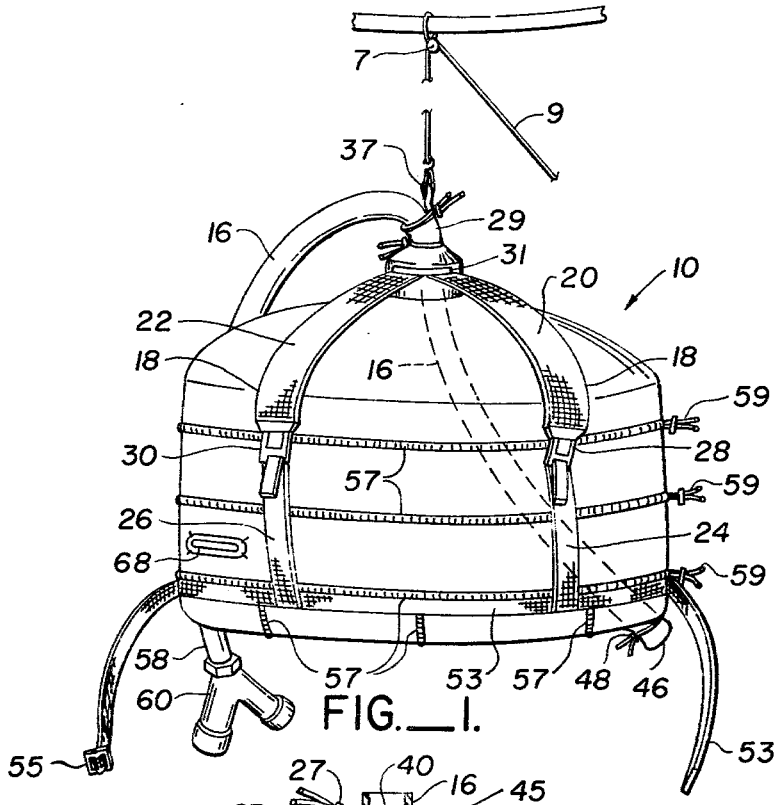
FIG. 1 is a front perspective of the portable water carrier and dispenser of the present invention.
Figure 3:
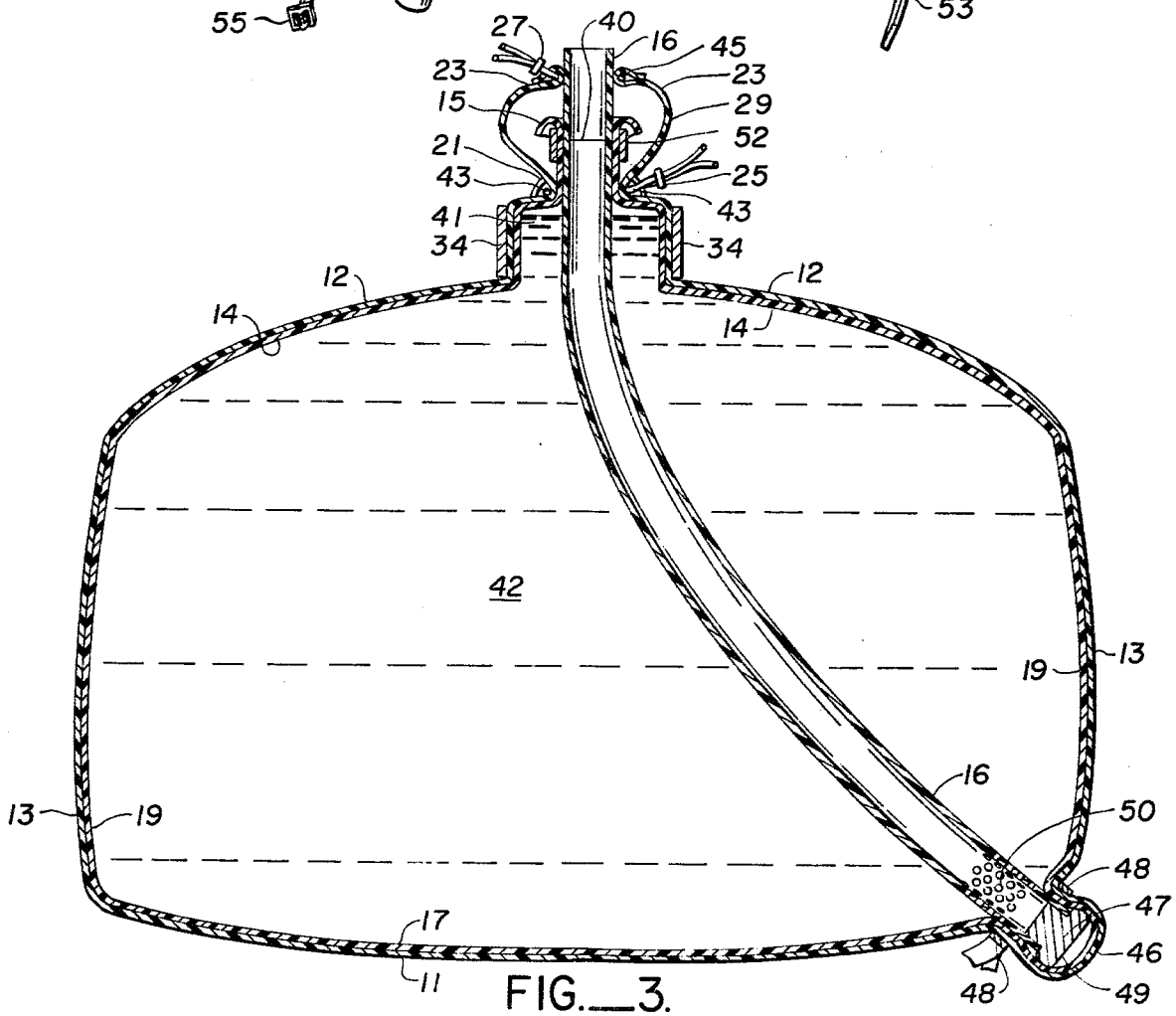
FIG. 3 is a side cross-sectional view of the enclosure and reservoir contained therein illustrating the supportive containment provided the reservoir by the enclosure, the protected elastic seal at the top of the reservoir, and attachment of the end of the conduit interior the reservoir.
Figure 2:
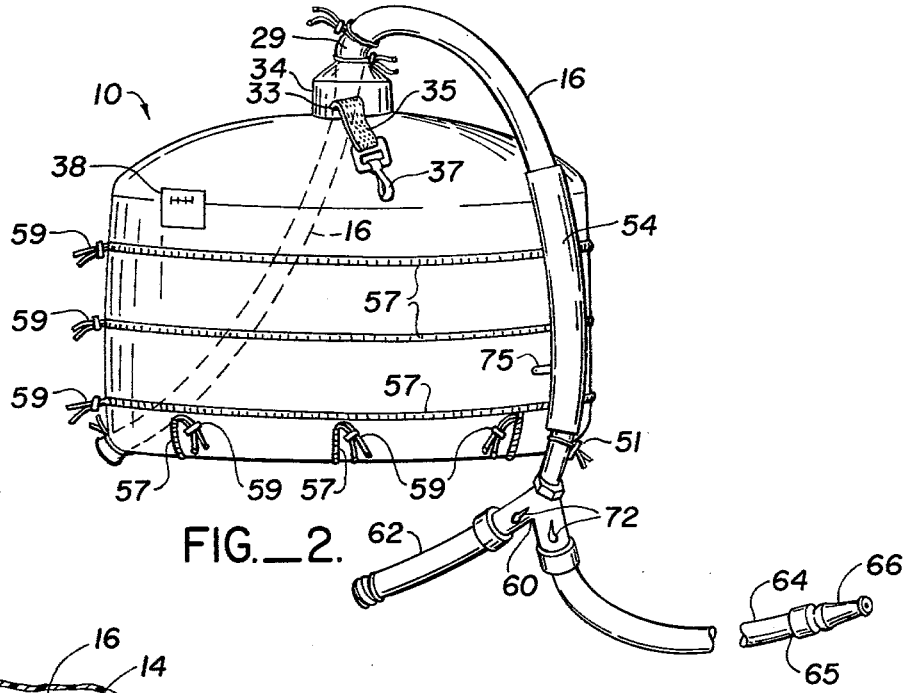
FIG. 2 is a rear perspective of the portable water carrier and dispenser of the present invention.

Turning now to the drawings, FIGS. 1-3 illustrate the preferred embodiment of the invention. As seen in these figures, a portable water-carrying and dispensing device, generally designated by reference numeral 10, includes enclosure 12 containing reservoir 14, and, for establishing fluid communication with the reservoir, conduit 16. Enclosure 12 is provided with shoulder straps 18 comprising wide padded upper sections 20, 22 and narrow unpadded lower sections 24, 26. Upper and lower sections 20, 22 and 24, 26, respectively, of shoulder straps 18 are connected with buckles 28, 30 which allow for adjustments in length and tension. Shoulder straps 18 are attached by stitching to lower part of enclosure 12 and to reinforced (preferably 2" wide nylon) band 31 near top of enclosure 12. Waistbelt 53 is likewise attached to enclosure 12 by stitching, and is provided with buckle 55 which allows for adjustments in length. Waistbelt 53 minimizes bouncing and swaying, of the device 10 while it is being carried.

FIG. 3 illustrates the method of closing the reservoir 14 and enclosure 12 about conduit 16 at the top of the device. This will normally be done before introducing water into the device. Reservoir 14 is gathered about conduit 16 at location 40 and then is bound tightly to the conduit by multiple wraps of a flattened elastic cord 52 such as elasticized cotton tape. A large strip of rubber could be used here, but would have more tendency to break. Location 40, on conduit 16, is permanently marked to eliminate guesswork in finding the proper height at which to bind reservoir 12 to conduit 16. A line could also be marked on the reservoir, approximately one inch below the top of the reservoir to further aid in locating the proper place to make the binding 52.

After reservoir 14 is secured about conduit 16, elasticized drawstrings 43 and 45, in drawstring guides 21 and 23, are tightened just below and above, respectively. This seal is secured by drawstring locks 25 and 27, respectively.

Thus, a protected area is provided for this seal and the excess reservoir material 15 which protrudes above the seal from the material 29 at the top of the enclosure 12. The upper elasticized drawstring 45 serves to prevent the entry of dirt, bark, leaves, insects and other foreign matter into this area, and to protect it from puncture or abrasion. The lower elasticized drawstring 43 serves to protect this seal by minimizing the impact on it from the water 42 in the reservoir just below, during climbing, and like activities. In case the device is dropped, lower drawcord 43 will prevent rupture of the reservoir at the top by placing the strain on the enclosure rather than the reservoir 14 and the elasticized seal 52 closing the reservoir about conduit 16.

Before transport, the water in the reservoir will normally be brought to the level shown in FIG. 3 by use of the locking drawcords 57 (FIGS. 1 and 2) attached to the enclosure 12. These drawcords can be used to make minor adjustments in the shape of the reservoir to suit the person carrying it or to change its shape radically for alpine use or for transport by horseback, bicycling, or other means. Once the drawcords 57 are tightened as desired, the drawcord locks 59 are tightened to hold the reservoir in the shape wanted. The pillow shape shown in the illustrations keeps the load close to the body and well distributed. In addition, it can be easily adapted to another shape when desired.

Reservoir 14, contained within enclosure 12, has the same general shape as that of the enclosure. In order to provide appropriate support for reservoir 14, when the reservoir is containing water, it is preferable that the volumetric dimensions of the reservoir be slightly larger than the corresponding dimensions of enclosure 12 within which the reservoir is situated. Actually, the reservoir could be made the same size as the enclosure if fabrication of the two were closely controlled, and if the dispenser would be kept relatively stationary while full. But it is advisable to increase the dimensions of the reservoir slightly over those of the enclosure to allow for differences in fabrication and to insure continuous support for the reservoir while the apparatus is being transported or otherwise jostled about. Thus, as FIG. 3 illustrates, as reservoir 14 fills with water 42 the bottom 11 and sidewalls 13 of the enclosure 12 retain and support the corresponding bottom 17 and sidewalls 19 of the reservoir.

Figure 4:
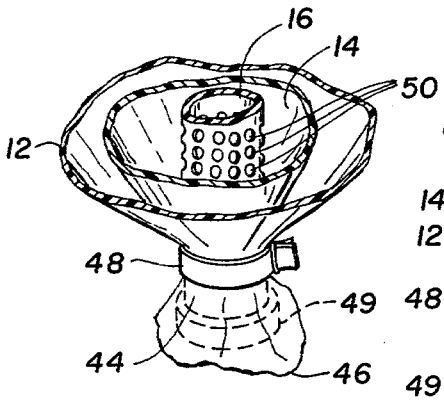
FIGS. 4 and 5 are a partial elevated view and a cross-sectional view, respectively, of the end of the conduit interior the reservoir further illustrating attachment and connection of the tubing to the bottoms of the reservoir and enclosure.
Figure 5:
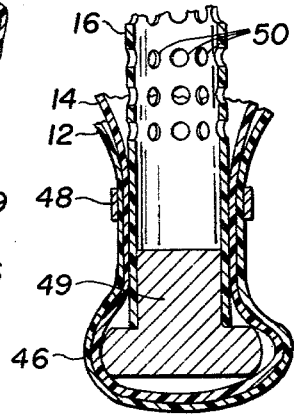

Contained within and extending out of reservoir 14 through opening 15 thereof is conduit 16. Conduit 16 is preferably made of very lightweight, half-inch diameter vinyl hose. Conduit 16 has, situated inside reservoir 14, end 44 positioned at the bottom 17 of the reservoir (FIGS. 3-5). Firmly inserted in end 44 of the conduit is plug 49, which has a mushroom-shaped head 47 exterior of the conduit. With end 44, and plug 49 inserted therein, situated adjacent both bottoms 11, 17 of the enclosure 12 and reservoir 14, respectively, at point 46, the enclosure and reservoir are gathered about conduit 16 near end 44. Fastening clamp 48, a short piece of elasticized cotton tape, sewn to the outside of the enclosure immediately above point 46, is then wrapped and tied around the enclosure so gathered about conduit 16. Thus, end 44 of conduit 16, reservoir 14, and enclosure 12 are all releasably secured together at bottom point 46 by fastening clamp 48, thereby anchoring the end to bottoms 17, 11 of the reservoir and enclosure, respectively. Circumferentially located in conduit 16, proximate end 44, are a plurality of apertures 50 which allow free flow of water into and out of reservoir 14 from and to the conduit 16. Placement of apertures 50, with respect to end 44, is such that the apertures remain unhampered by the attachment of fastening clamp 48.

It is advantageous at this point to pause and note the unique advantage obtained from the particular use and placement of apertures 50, in conjunction with reservoir 14. Assume, for the moment, that end 44 of conduit 16 is inserted within reservoir 14 so that it is merely proximate bottom 17 of the reservoir but not attached as in the Figures. In order to evacuate as much water as possible from the interior of reservoir 14, end 44 should be placed as near bottom 17 of the reservoir as possible. However, merely positioning end 44 proximate bottom 17 of reservoir 14 gives rise to the possibility that as the water flows into conduit 16 from the reservoir, portions of bottom 17 of the reservoir, which is preferably fabricated from a highly flexible and thin plastic material, could be drawn into and clog the conduit 16. Therefore, the attachment of conduit 16 to bottom 17 of reservoir 14, concomitant with the circumferentially located apertures, illustrated in FIGS. 3 and 4, prevents any such interference of water flow. Any water remaining in, and yet to be evacuated from, reservoir 14 will remain on bottom 17 and act to hold the reservoir material away from apertures 50.

Once the water enters the reservoir, it serves to hold it in place within the enclosure. However, when empty, the reservoir needs to be held in place within the enclosure to prevent twisting and resultant stress concentration after filling.

Elastic seal 52 holds the top of the reservoir 14 in place within the enclosure. The reservoir about the interior end of the conduit 16 and anchors the end to a bottom corner of the enclosure by the fastening clamp 48. All that is needed to complete fixing the reservoir in place within the enclosure is to anchor the opposing lower corner. This is done by snap clamp 67.

Figure 8:
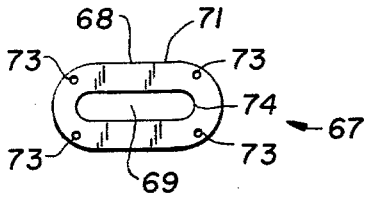
FIGS. 7 and 8 illustrate the male and female sides, respectively, of the snap clamp used to hold the reservoir in place within the enclosure when the reservoir is empty.
Figure 7:
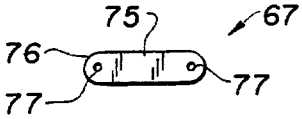

Snap clamp 67 has a male and a female side 75 and 68, respectively, shown in FIGS. 8 and 7, respectively. The male and female sides of snap clamp 67 are fastened in confronting relation to the outside surfaces of the back and front of the enclosure, respectively (with the material of the front and back portions of the enclosure and reservoir positioned therebetween), and near the corner opposite the fixed end of the conduit 16. The female side 68 of the clamp is made of a flat, flexible piece of plastic such as polyethylene. It has an elongated slot down the center of its long axis which opens slightly to allow material of both the front and back portions of the enclosure and reservoir, together with the male side 75 of the clamp, to pass therethrough. The material of the enclosure and reservoir is thereby temporarily captured. It is attached loosely to the front side of the enclosure by sewing through the holes 73 provided for this purpose. It is attached loosely so as to allow enough slack for the male side of the clamp and the material adjacent to it to be pushed all the way through the female side of the clamp. The male side 75 of the clamp is made of a small cylindrical piece of plastic (or nylon preferably) which has been flattened, and then pierced, on the ends. It is attached to the back side of the enclosure by sewing through the holes 77 provided. It should be approximately one-third or less of the length of the slot 69 down the center of the female side of the clamp and the diameter should be sized small enough so that the two sides of the snap will part spontaneously when the reservoir is approximately half-full. Once the reservoir begins filling, as was mentioned earlier, this clamp will not be needed, as the water itself holds the bottom of the reservoir in place within the enclosure. At this time, the clamp can be opened by a pinch. Or, it can be left to open by itself as increasing pressure from within forces the two sides apart. Care should be taken in fabrication to avoid sharp edges at the inside 74 of the female side of the clamp and on the edges 76 of the male side of the clamp, too. It is convenient to have this clamp attached to the enclosure for use when needed. However, if one spends a great deal of time hiking through heavy brush, he may wish to remove this permanent clamp in order to prevent it from catching on bushes, etc. In this case, a clothespin (preferably of wood or nylon, and stainless steel—note that no other part of this apparatus is vulnerable to rust, rot, or other water damage) carried with the camper will serve the same purpose as the snap clamp 67 described above.

As FIG. 1 illustrates, conduit 16 extends out of top 32 of enclosure 12 to run down along the back of the enclosure; sleeve 54 is provided to hold conduit 16 to the back of enclosure 12. Attached to end 58 of conduit 16 is Wye connector 60. Removably coupled to connections 63, 63' are conduits 62 and 64. These are preferably made of very lightweight half-inch diameter vinyl hose like conduit 16. Removably coupled to end 65 of tubing 64 is portable shower head 66. Portable shower head 66 is preferably made of lightweight plastic and will adjust its spray or shut-off with a twist. Such nozzles are readily available in garden stores.

Referring now to FIG. 5, Wye connector 60 and its functions can be more fully explained. The coupling between Wye connector 60 and end 58 of conduit 16 is achieved through the use of commercially available threaded connections, such as the type used on ordinary garden hoses. Similarly, the coupling between conduits 62 and 64 and connections 63, 63' of Wye connector 60 are of the same type. Wye connector 60 is a double shut-off type connector, preferably constructed of plastic or other lightweight material, such as the type manufactured by Rainbird Manufacturing of Glendora, California. Wye connector 60 contains control valves (not shown), operated by valve levers 70, which control water flow between neck 61 and connectors 63. With valve levers 70 in the positions shown in FIG. 5, fluid communication is established between conduits 16, 62 and 64. A 90° counterclockwise rotation of left-hand valve lever 70 about left-hand lever axis 72 will close the left-hand valve (not shown), thereby terminating fluid communication between conduits 16 and 62. Similarly, fluid communication between conduits 16 and 64 may be terminated by a 90° clockwise rotation of right-hand valve lever 70 (FIG. 5) about right-hand lever axis 72. Any intermediate position of valve levers 70, 70' between full off and full on will provide a regulated flow.

Enclosure 12 is preferably fabricated from a lightweight nylon, although it may also be made of cotton canvas. Both materials possess the characteristics desired in the present invention—high strength, light weight and flexibility. Enclosure 12 is preferably fabricated of a material that is dark in color. The reason for a preferred dark color is that in the event device 10 is to be used as a portable shower, the device may be situated in sunlight prior to use. The dark color of enclosure 12 facilitates warming of the water contained by device 10 through the absorption of the sun's warming rays. Reservoir 14 may be fabricated from any highly flexible, thin material such as plastic or the like, which is impervious to water. Since support of bottom 17 and side wall 19 of reservoir 14 is provided by bottom 11 and side wall 13 of enclosure 12, strength of the material for the reservoir is not a factor. In fact, an added advantage from bottom and side wall support provided by enclosure 12 is that reservoir 14 may be fabricated from a material that lends itself to being disposable. Attachment collar 48 (which secures end 44 of conduit 16 to enclosure 12 and reservoir 14) and 52 (which closes and clasps to conduit 16 the opening of reservoir 14) is preferably flattened elasticized cotton tape, but may also be any convenient apparatus which serves the purpose, such as elastic bands, twine, or the like.

In use, the portable water-carrying and dispensing device 10 may be filled with water by any appropriate method, but is ideally adapted to siphoning techniques through the use of conduits 16, 62, 64 and Wye connector 60. To fill device 10 with water, shower head 66 is removed from end 65 of conduit 64 and end 65 placed in a water source (not shown), such as a stream or a lake. The lower end of conduit 62, and device 10 are placed in a position vertically below the water level of the source. Valve levers 70 are positioned so that the valves they control (not shown) establish water communication between conduits 16, 62, and 64. With conduit 16 held temporarily and manually closed as by crimping or the like, a siphoning action may be started by creating a negative pressure (such as by suction) in tubing 62. This will establish water flow through conduit 64, Wye connector 60, and conduit 62 while the camper manually holds conduit 16 closed. Left-hand valve lever 70 is then rotated to close its controlling valves while the crimping or pinching of tubing 16 is released, causing the water flow from conduit 64 to now be diverted through the Wye from conduit 62 to conduit 16 and into reservoir 14. The water flow will continue, via the siphoning action, until such time as reservoir 14 fills. When the filling operation is complete, the user then rotates right-hand valve lever 70 to terminate water flow through Wye connector 60 from conduit 64 to conduit 16. He may then unscrew conduits 62 and 64, mount device 10 upon his back and carry the water supply back to the camp site where it may be stored for use as a camp supply of water.

In the event water carrier and dispenser device 10 is to be used as a portable shower, the dispenser 10 may be hung from an elevated position as in FIG. 1 by use of the snap 37 which is attached by the nylon strap 35 to the reinforced band 34 near the top of the reservoir.

Figure 6:
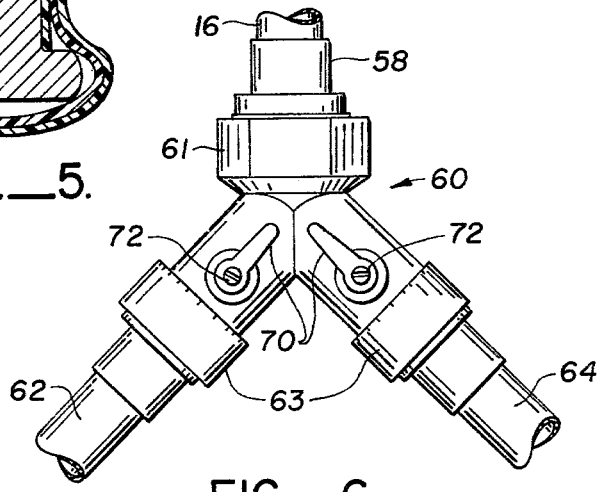
FIG. 6 illustrates a Wye connector having control valves to regulate flow into and out of the reservoir.

This strap is attached by "bar-tacking", an extremely strong, close stitching, to the reinforced band 34. The tops of the shoulder straps 37 are attached similarly on the reverse side of reinforced band 34. Raising and lowering the apparatus is facilitated by the use of a small pulley 7 and nylon parachute cord 9, or other light, strong cord, as shown in phantom in FIG. 1. Use of a pulley also avoids cutting branches. Conduit 62 or 64 may then be attached to Wye connector 60 and shower head 66 attached to the particular conduit as shown in FIG. 1. Water will exit reservoir 14 via conduit 16, Wye connector 60 and conduit 64 under a siphoning action with the amount of water exiting conduit 64 controlled by right-hand valve lever 70 (FIG. 6).

Fastening clamp 51 is a flat piece of elasticized cotton which is sewn to the back of the enclosure as shown in FIG. 2. It anchors the conduit 16 against up and down motion, while sleeve 54 prevents side-to-side motion.

Zippered pocket 38 holds an extra reservoir in a small protective sack of its own, a small pulley, a clothespin, if desired, and some extra elasticized cotton tape for use in location 52, 48, or 51. Everything else needed, except cord for raising and lowering the apparatus, and whatever additional Wyes and branches one may wish to carry, is attached. This avoids loss of time in locating pieces among the camper's other belongings, as well as missing pieces.

As is now apparent, water carrying and dispensing devices fabricated in accordance with the teachings of the present invention are relatively inexpensive to manufacture, simple to assemble, and easy to use. Portable water carrying and dispensing devices fabricated in accordance with the teachings of the present invention possess large capacity, yet are light in weight when empty, and are highly flexible such that they may be easily compacted and stored among a backpacker's other belongings for later use. Their use promises to greatly reduce pollution of our natural areas. They fill and empty quickly, without venting, and carry a maximum load of water easily. They are essentially free from leaks and couple together quickly to form larger systems when desired. They can be easily adapted by the attached locking drawcord system to suit the person carrying them or to fit a different mode of transport. They seldom need replacement on the trail, and give the backpacker some much needed fire-fighting capacity besides providing him with warm or cool showers. As a portable water carrier and dispenser for any application, this invention is beyond comparison with anything formerly available.

While the above provides a full and complete disclosure of the preferred embodiment of the invention, various modifications, alternate constructions and equivalents may be employed without departing from the true spirit and scope of the invention. Therefore, the above description and illustrations should not be construed as limiting the scope of the invention which is defined by the appended claims.

For example, the shape of the enclosure may be changed radically to better suit different modes of transport, an extra layer of insulating material or reflective membrane may be added to the outside of the enclosure to prevent freezing in cold weather, or the top of the enclosure may be zippered to provide an auxiliary knapsack. A much larger unit, portable only when empty, may be made for a larger camp—perhaps with the bottom supported on the ground.

I claim:

1. A portable water carrier and dispenser, comprising:

a bag-like enclosure having an open ended side wall and a bottom portion defining a predetermined volume, said enclosure formed of flexible substantially non-elastic material;

a reservoir member removably disposed within the enclosure, said reservoir member being formed of flexible material adapted to receive and retain water and provided with a configuration having volumetric dimensions at least as large as the predetermined volume of the enclosure such that when containing water the reservoir member will be supported by the side and bottom walls of the enclosure;

siphon means to establish fluid communication with the reservoir member for allowing water contained in the reservoir member to be siphoned therefrom, the siphon means including a flexible tube having one end extending into and removably attached to the bottom of the reservoir member;

a first closure member fabricated from an elongate elasticized material that is multiply-wrapped and releasably attaches circumferentially about the flexible tube at a predetermined point along said tube, the reservoir being gathered about the flexible tube by the first closure member to establish a water-impervious seal between the flexible tube and the reservoir;

second and third closure members releasably attached to the flexible tube in juxtaposed relation to the first closure member and said first closure member being interjacent said second and third closure members, the enclosure being gathered about and held to the flexible tube by the second and third closure members; and a pair of shoulder straps connected to the enclosure for mounting the water carrier and dispenser on the back of a person.

2. The water dispenser of claim 1 wherein the flexible tube is provided with a plurality of holes in its side walls proximate said one end.

3. The water dispenser of claim 2, including suspending means attached to the enclosure for suspending the water dispenser from a support.

4. The water dispenser of claim 1, wherein said second and third closure members are fabricated of an elasticized material.

5. The water dispenser of claim 1, including means attached to the enclosure for adjusting lateral dimensions of the enclosure, the adjustment means including at least a pair of spaced drawcords that laterally encircle and are coupled to the enclosure, the drawcords being adapted to tighten about the enclosure to effect adjustment of the lateral dimensions thereof.

6. A portable water dispensing apparatus to be carried on the back of a person, said apparatus comprising:

a bag-like enclosure formed of thin, flexible, substantially non-elastic material;

a reservoir member disposed within the enclosure, said reservoir member being formed of flexible material adapted to receive and retain water;

a siphon tube for establishing fluid communication with the interior of the reservoir member for evacuating water contained therein, said siphon tube having a distal end formed to have an enlarged section situated interior of the reservoir member, the siphon tube including a plurality of holes located proximate said enlarged section;

a tie element that circumferentially surrounds and captures the siphon tube proximate the enlarged section with the enclosure and reservoir member gripped between the tie element and the siphon tube; and a pair of shoulder straps attached to the enclosure for mounting the water dispenser upon the back of a person.

7. The water dispenser of claim 6, wherein the reservoir member includes bottom and side walls defining a bag, said bag being removably disposed within the enclosure and having volumetric dimensions proportioned in reference to the enclosure so that the reservoir member is supported by the enclosure when the reservoir member is charged with water.

8. The portable water dispensing apparatus of claim 7, including suspending means attached to the enclosure for suspending the dispensing apparatus from a support.

9. A portable water carrying and dispensing apparatus adapted to be carried on the back of a person, said apparatus comprising:

a bag-like enclosure having an open ended side wall and a bottom portion defining a predetermined volume, said enclosure formed of a flexible, substantially non-elastic material;

a reservoir member disposed within the enclosure, said reservoir member being formed of a flexible liquid-impervious material and provided with a configuration having volumetric dimensions at least as large as the predetermined volume of the enclosure such that when containing water the reservoir member will be retained and supported by the side and bottom walls of the enclosure;

a tubular siphon conduit extending from the reservoir member and enclosure and having one end disposed interior the reservoir member fixed adjacent the bottom wall thereof to establish fluid communication with said reservoir member so that the water stored in the reservoir member can be dispensed substantially in toto by the siphon conduit, the one end having an enlarged section formed at the terminal portions thereof, the conduit having a plurality of holes in its side wall proximate the enlarged section;

means positioned circumferentially about the conduit intermediate the enlarged section and the plurality of holes for releasably gathering and holding thereabout the periphery of the enclosure side wall;

means carried by the enclosure for suspending the enclosure from a support; and a pair of shoulder straps attached to the enclosure for mounting the water dispenser upon the back of a person.

10. A portable water carrier and dispenser, comprising:

a bag-like enclosure having an open ended side wall and a bottom portion defining a predetermined volume, said enclosure formed of flexible substantially non-elastic material;

a reservoir member removably disposed within the enclosure, said reservoir member being formed of flexible material adapted to receive and retain water and provided with a configuration having volumetric dimensions at least as large as the predetermined volume of the enclosure such that when containing water the reservoir member will be supported by the side and bottom walls of the enclosure;

a flexible tube to establish fluid communication with the reservoir member for allowing water contained in the reservoir to be siphoned therefrom, the flexible tube having one end extending into the reservoir member and fixed to the bottom thereof;

a first closure member releasably attached circumferentially about the flexible tube at a predetermined point along said tube, the reservoir member being gathered about the flexible tube by the first closure member to establish a water impeding seal between the flexible tube and the reservoir member;

second and third closure members releasably attached to the flexible tube in juxtaposed relation to the first closure member and said first closure member being interjacent said second and third closure members, the enclosure being gathered about and held to the flexible tube by the second and third closure members; and a pair of shoulder straps connected to the enclosure for mounting the water carrier and dispenser on the back of a person.

11. The water dispenser of claim 10, wherein said closure members are fabricated of an elasticized material.

* * * * *